US009539466B1

(12) United States Patent
Schoner

(10) Patent No.: US 9,539,466 B1
(45) Date of Patent: Jan. 10, 2017

(54) SYSTEM FOR IMPROVING THE POWER DELIVERED BY A RIDER TO A PEDDLE-OPERATED VEHICLE

(71) Applicant: Brian Schoner, Fremont, CA (US)

(72) Inventor: Brian Schoner, Fremont, CA (US)

( * ) Notice: Subject to any disclaimer, the term of this patent is extended or adjusted under 35 U.S.C. 154(b) by 0 days.

(21) Appl. No.: 15/002,209

(22) Filed: Jan. 20, 2016

(51) Int. Cl.
*A63B 69/16* (2006.01)
*A63B 23/04* (2006.01)

(52) U.S. Cl.
CPC ..... *A63B 23/0476* (2013.01); *A63B 21/4009* (2015.10); *A63B 21/4011* (2015.10); *A63B 21/4015* (2015.10)

(58) Field of Classification Search
USPC ..... 482/57–65
See application file for complete search history.

(56) References Cited

U.S. PATENT DOCUMENTS

| | | | | |
|---|---|---|---|---|
| 3,230,952 | A * | 1/1966 | Reyes Terron | A61F 5/0102 403/113 |
| 4,602,627 | A * | 7/1986 | Vito | A61F 5/0102 602/23 |
| 7,458,949 | B2 * | 12/2008 | Castillo | A61F 5/0123 128/882 |
| 7,578,800 | B2 * | 8/2009 | Castillo | A61F 5/0123 128/882 |
| 9,452,075 | B2 * | 9/2016 | Berg | A61F 5/0123 |
| 2003/0166435 | A1 * | 9/2003 | Arad | A63B 21/157 482/57 |

* cited by examiner

*Primary Examiner* — Stephen Crow
(74) *Attorney, Agent, or Firm* — Michael W. Caldwell

(57) ABSTRACT

A system comprising structures connected to the rider of human-powered vehicles improves the force a rider may apply to the vehicle. The elements are primarily connected to the lower body and legs of the rider, with attachment to the rider's shoes, whereby a two-dimensional four-bar linkage is formed. Use of the system may permit a rider to go faster or farther with less effort. An optional novel shoe may be used with or without the other elements of the system.

3 Claims, 8 Drawing Sheets

SYSTEM FOR IMPROVING THE POWER DELIVERED BY A RIDER TO A PEDDLE-OPERATED VEHICLE

BACKGROUND

Bicycles are a popular and efficient form of transportation, with a long history of invention and improvement. Many communities are developing an ever-growing matrix of bike paths, encouraging people to ride a bike to work as a way to both improve health and lower greenhouse gas generation. As bike riding has become more popular, so too has physical training and conditioning to improve one's bike riding performance. There are many products now available to measure a rider's performance, intended to provide motivation to perform better and/or improve conditioning, which may lead to better performance. There are many bike riding accessories and improvements in equipment to provide somewhat better performance. In some cases such equipment may not be permitted during competition but are used by riders to improve their performance when not using the equipment. Such equipment may be of interest to those that do not compete simply to improve their experience, perhaps enabling them to ride farther or faster than they otherwise may be able to do.

SUMMARY

A system for improving a person's pedaling efficiency is disclosed herein. The system couples rotation of a person's foot connected with a pedal on a human-powered vehicle with rotation of a corresponding thigh. When torque is applied by the foot with a plantar flexion, the system transfers the torque to a corresponding thigh. This results in hip extension, thereby adding force to assist in pushing the pedal downward. The system is a passive mechanical linkage, with all power provided by the legs of the rider.

BRIEF DESCRIPTION OF THE DRAWINGS

The accompanying drawings, which are incorporated herein and constitute part of this specification, illustrate exemplary aspects of the invention, and, together with the general description given above and the detailed description given below, serve to explain features of the invention.

DETAILED DESCRIPTION

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

To make the disclosure more clear, references relative to "left" or "right" are interchangeable. Also, elements that are referenced on one side of the system will carry the same reference number as the same element on the other side of the system. The plural may apply to the singular, and the singular may apply to the plural in all references and in the description.

The instant invention may be beneficial when used while operating any pedal-powered apparatus. Examples include rickshaws, basic electricity generators, pumps (such as emergency pumps), and of course bicycles providing for any number of riders.

Figure 1:
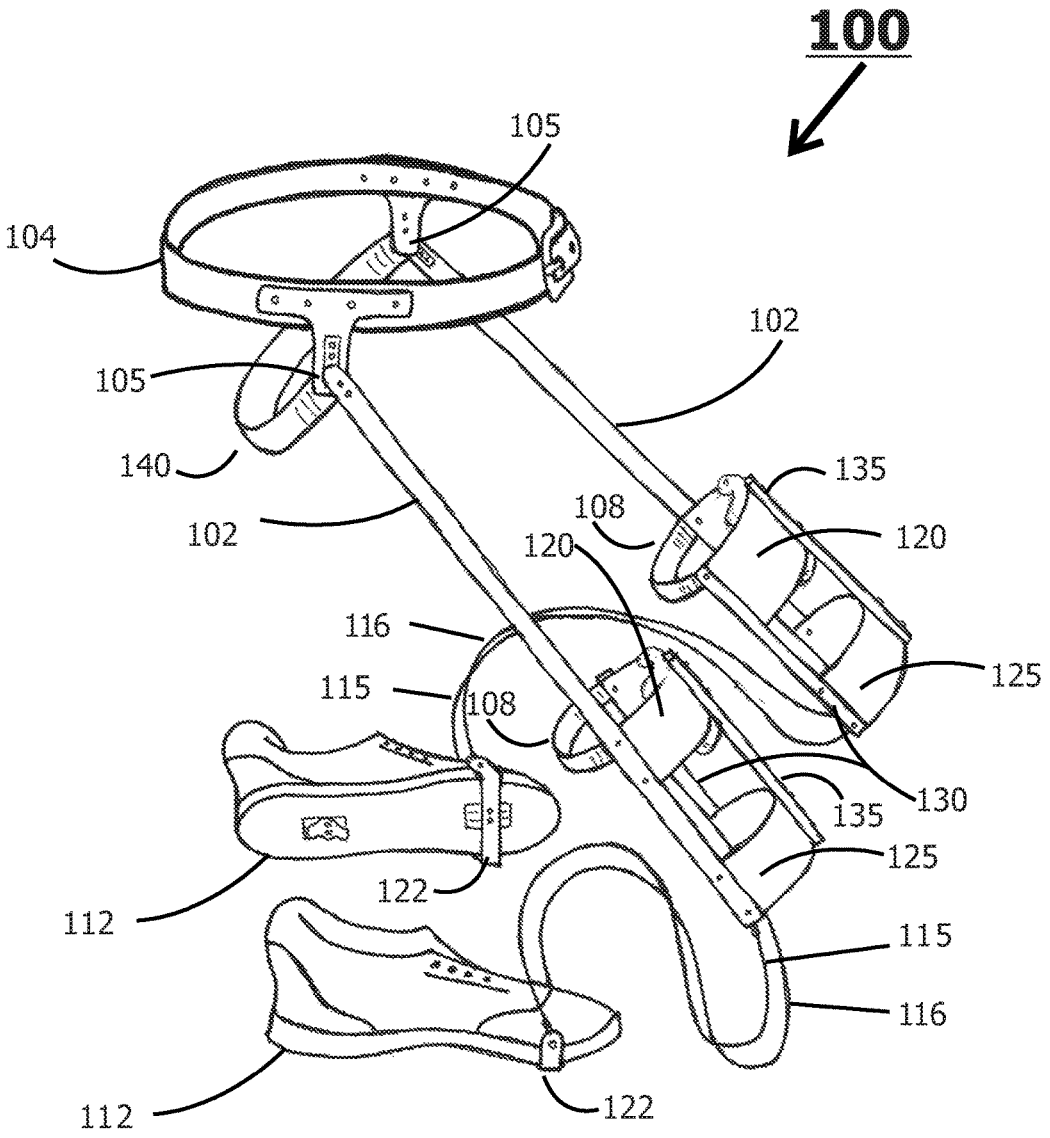
FIG. 1 is a perspective view of the system components.

FIG. 1 is a perspective drawing of the components comprising a system 100. The system 100 comprises outer thigh linkages 102, connected to a body harness 104 by hinged connectors 105. The connectors 105 may allow rotation of the outer thigh linkages 102 relative to the body harness 104. Cables 115, 116, sometimes collectively denominated as a "coupler", connect outer thigh linkages 102 to shoes 112. The coupler comprises one or two wires 115, 116.

Figure 2:
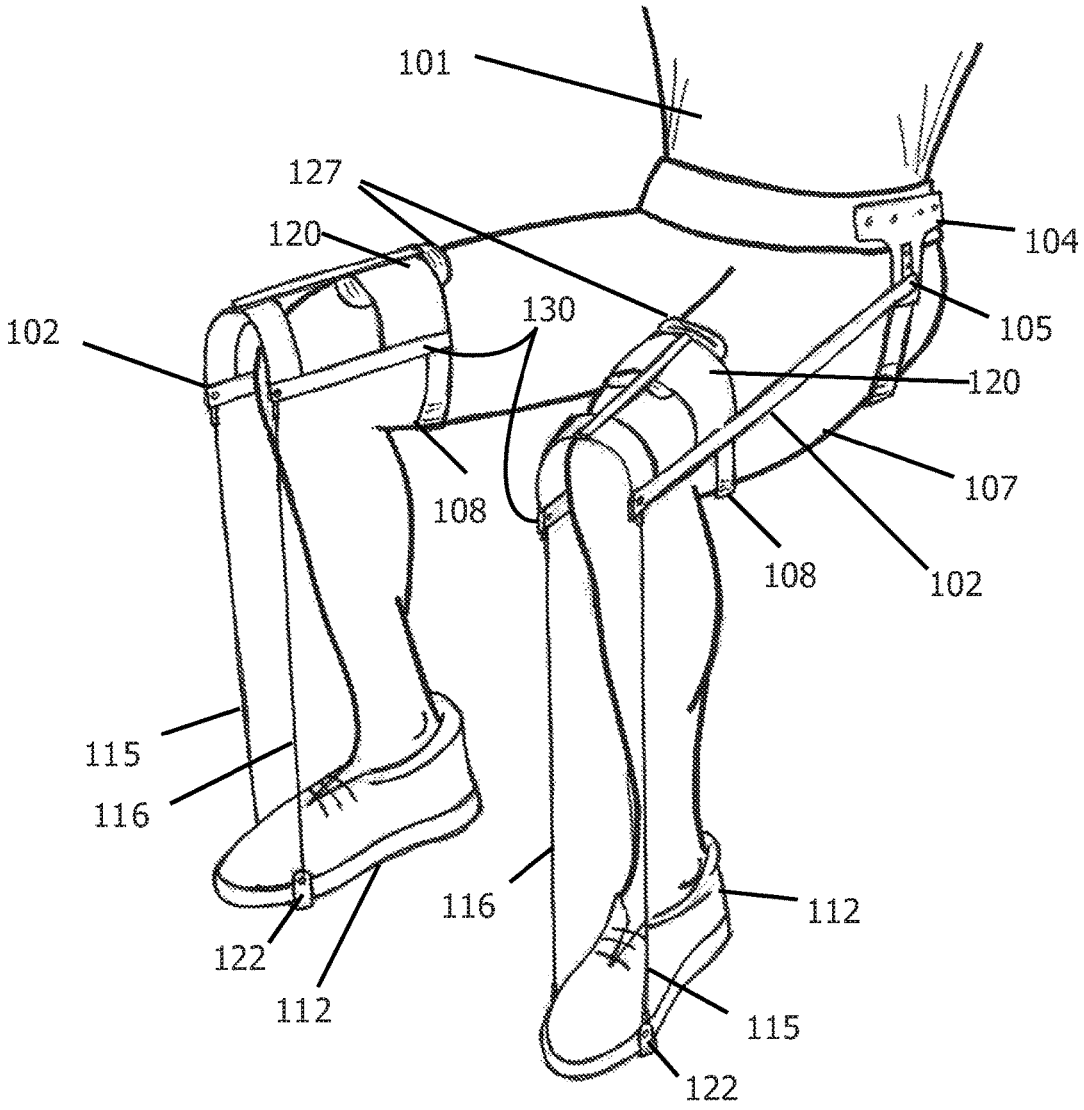
FIG. 2 is a perspective view of the system as worn by a person.

An upper thigh brace 120 and a lower thigh brace 125 are connected to the outer thigh linkages 102 on the braces' 120, 125 outside ends and inner thigh linkages 130 at the braces' 120, 125 inner edges. Optionally, the thigh braces 120, 125 may also be connected with each other by top connectors 135. Straps 108 connecting the outer thigh linkages 102 to the inner thigh linkages 130 complete an encircling attachment, thereby capturing a rider's thigh 107 (FIG. 2). A strap 140, connected to the hinges 105, may go under a rider's buttocks to secure the body harness 104. In some embodiments only a single coupler (115 or 116) is provided, though providing both may provide better stability to the rider's foot and prevent rotation of the linkages 102, 130 and thigh braces 120, 125 about the longitudinal axis of the thigh 107.

Looking to FIG. 2, we see a perspective drawing of the system 100 as worn by a person 101. In some embodiments the outer thigh linkages 102 extend past the wearer's knees, thereby providing clearance for the couplers 115, 116. In some embodiments pads 127 may be placed underneath the uppermost thigh braces 120 for comfort.

FIG. 2 further illustrates couplers 115, 116 connecting the outer thigh linkages 102 and 130 to shoes 112 worn by a rider. A plate 122 under the rider's shoe 112 connects to the coupler 115, 116 and thereby to the outer thigh linkages 102. The plate 122 may be rigid, for example comprised of metal, or flexible.

Figure 3:
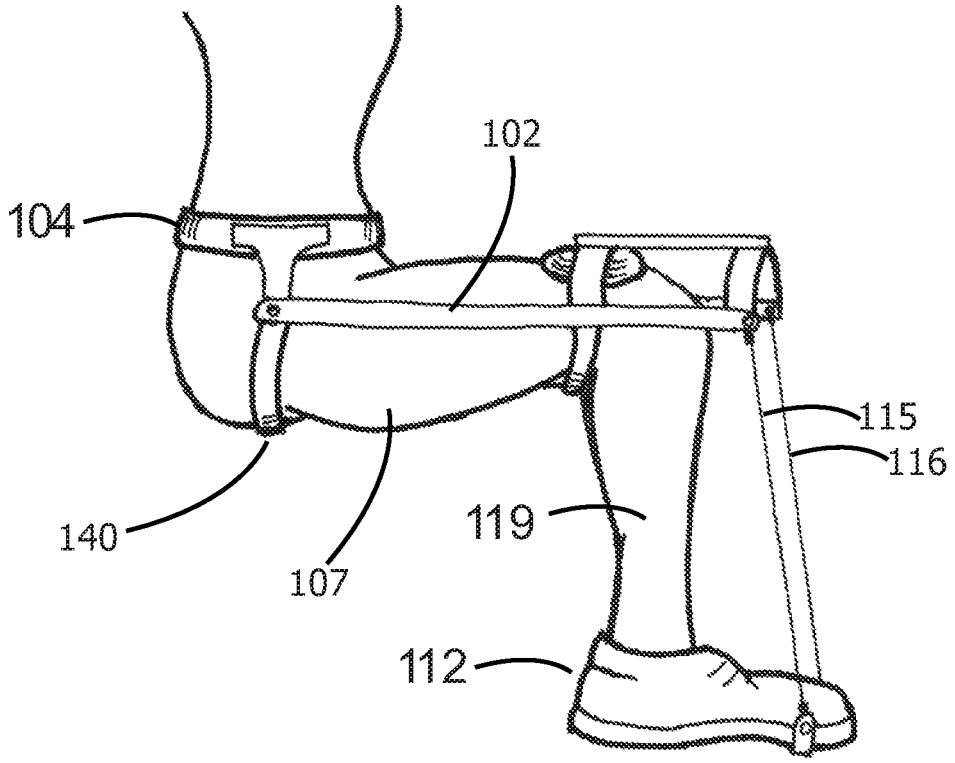
FIG. 3 is a side view of the system on a person's leg with the hip flexed, knee bent, and foot parallel to the thigh.
Figure 4:
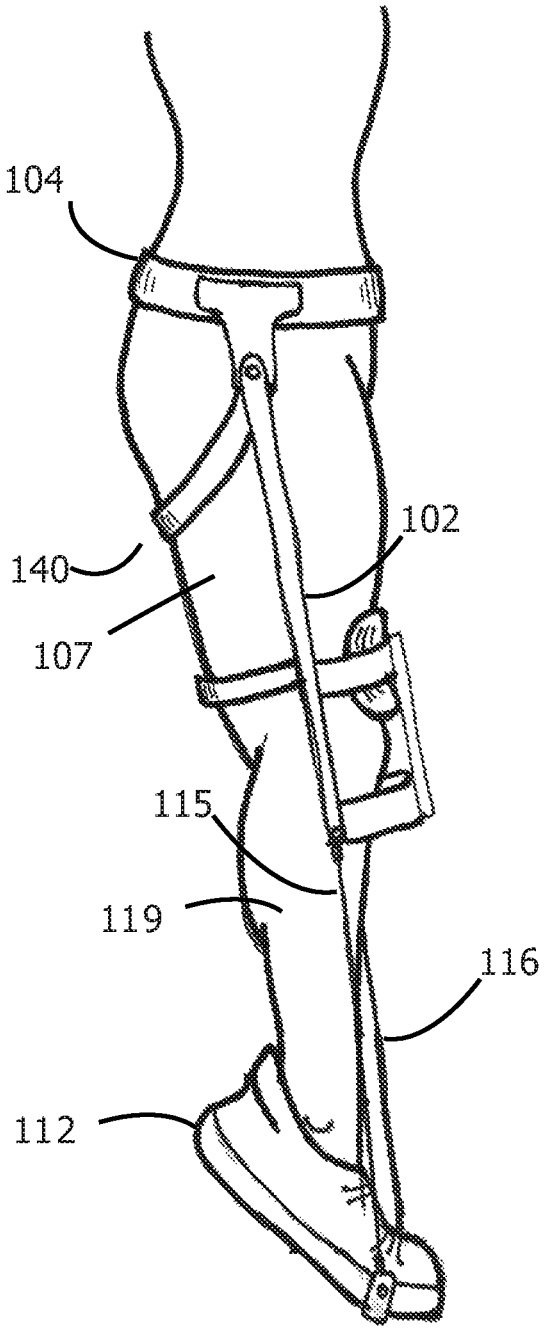
FIG. 4 is a side view of the system on a person's leg with the hip, knee, and toes extended.

FIG. 3 and FIG. 4 show an example of operation of the system. FIG. 3 is a side view of the system 100 attached to a rider's leg 107 while the hip is flexed. As viewed from the side, the system approximates a two-dimensional four-bar linkage or pantograph. The shoe 112 and outer thigh linkage 102 provide the rotating cranks. The shin 119 and coupler 115, 116 provide the couplings, whereby movement of the shoe 112 causes rotation of the outer thigh linkage 102.

FIG. 4 is a side view of the system 100 with the wearer's leg extended and the shoe 112 rotated with the toe downward, as may occur while pedaling a bicycle. Note that the shoe 112 and outer thigh linkage 102 may be rotated together in the plane of motion. The outer thigh linkage 102 is connected to the body harness 104 at the hip, such that the thigh 107 and outer thigh linkage 102 have a common axis of rotation.

Figure 5:
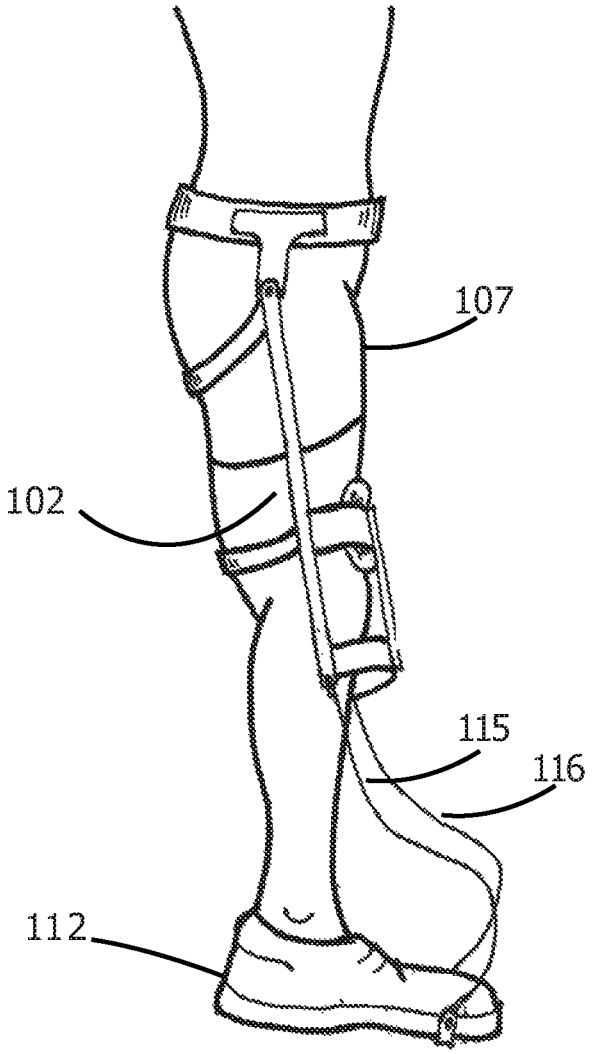
FIG. 5 is a side view of the system on a person's leg when in a standing position.

FIG. 5 is a side view of the system 100 attached to a wearer's leg wherein the wearer is in a standing position.

The coupler 115, 116 is slack, thereby permitting a comfortable standing position. The standing position might be difficult if the coupler 115, 116 were instead rigid.

FIG. 5 also illustrates the coupler 115, 116 flexing to allow plantar extension (the shoe 112 approximately orthogonal to the longitudinal axis of the leg) while the hip is extended (the outer thigh linkage 102 nearly vertical). The flexible coupler 115, 116 allows a bicycle rider to raise his toes to avoid small obstacles on the ground. This feature may be useful when the bicycle is leaning to one side for turning, since one pedal would be closer to the ground than the other.

Figure 6:
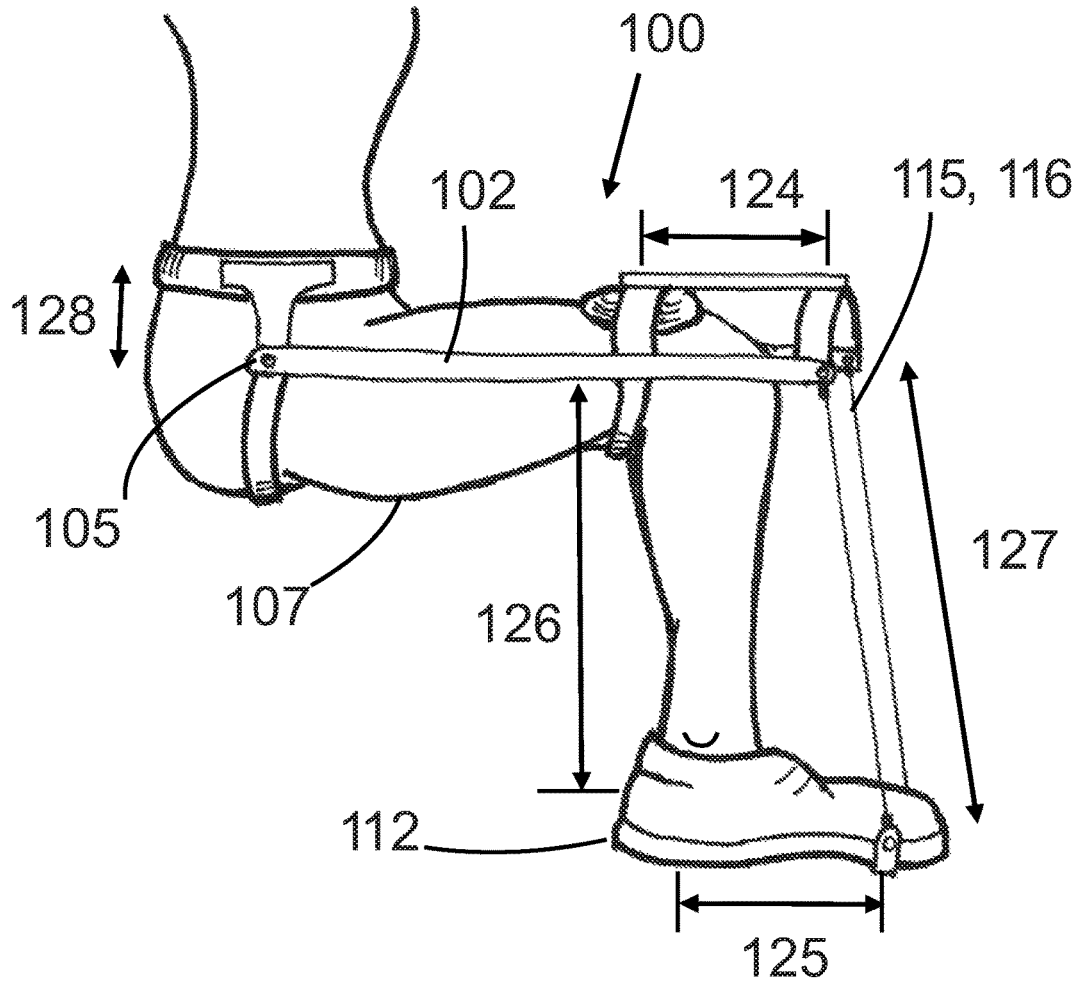
FIG. 6 relates geometric relationships between the various structural members of the disclosed system.

FIG. 6 is a side view of the system 100 attached to one leg, illustrating lengths and adjustments of the various elements. Length 124 is the distance between the knee and coupler 115, 116. Length 125 is the distance between the ankle and coupler 115, 116. The relative rotation of the shoe 112 and the outer thigh linkage 102 depends on the ratio of length 124 to length 125. Length 124 may be adjusted by attaching the coupler 115, 116 to different points on the outer thigh linkage 102. Length 125 may be adjusted by attaching the coupler 115, 116 to different points on the shoe 112.

Length 126 is the distance between a wearer's knee and ankle. Length 127 is the length of the coupler 115, 116. Length 126 and length 127 may be approximately equal, such that the ankle is extended when the hip is flexed. The length of the coupler 115, 116 may be adjusted to provide an offset between ankle rotation and hip rotation.

Length 128 is the distance between the person's waist and the thigh linkage connector 105. Length 128 aligns the outer thigh linkage 102 with the thigh, such that the thigh linkage and thigh are aligned, and move together comfortably. Length 128 may be adjusted to match the size and shape of the wearer.

Figure 7:
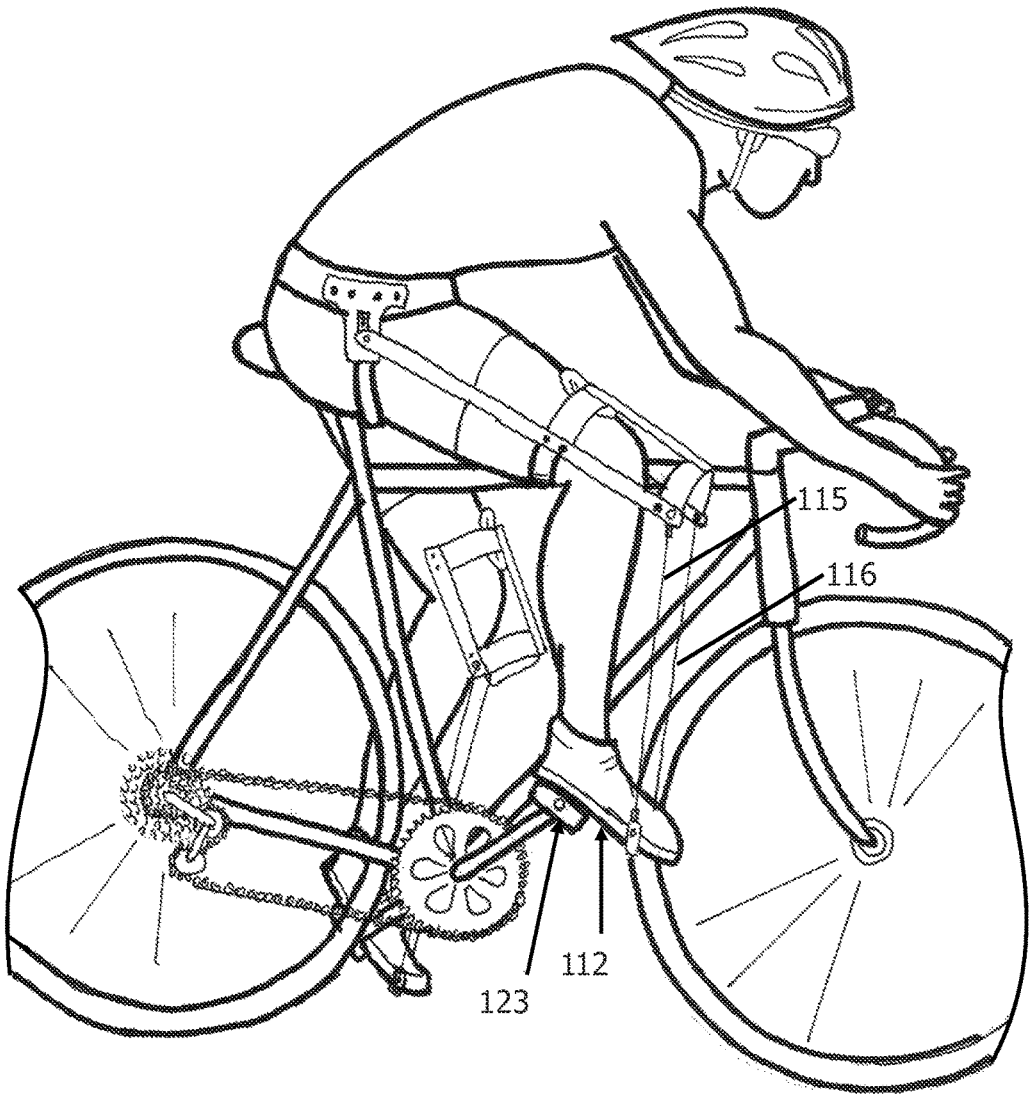
FIG. 7 is a view of the system as worn by a person riding a bicycle.

FIG. 7 shows the system 100 on a bicyclist with a shoe 112 on a pedal 123. The pedal 123 is approximately below the ankle. The coupler 115, 116 connects to the shoe 112 near the ball of the foot, forward of the pedal 123. Standard bicycle shoes typically place a pedal cleat under the ball of the foot. System performance is enhanced with the shoe 112 positioned relative to the pedal 123 as shown in FIG. 7.

Bicycle riders may need to become accustomed to the new shoe position shown in FIG. 7. For training purposes, a shoe could allow a range of pedal placement. Beginners could start with a standard pedal placement, and gradually adjust to the pedal position shown in FIG. 7.

Figure 8:
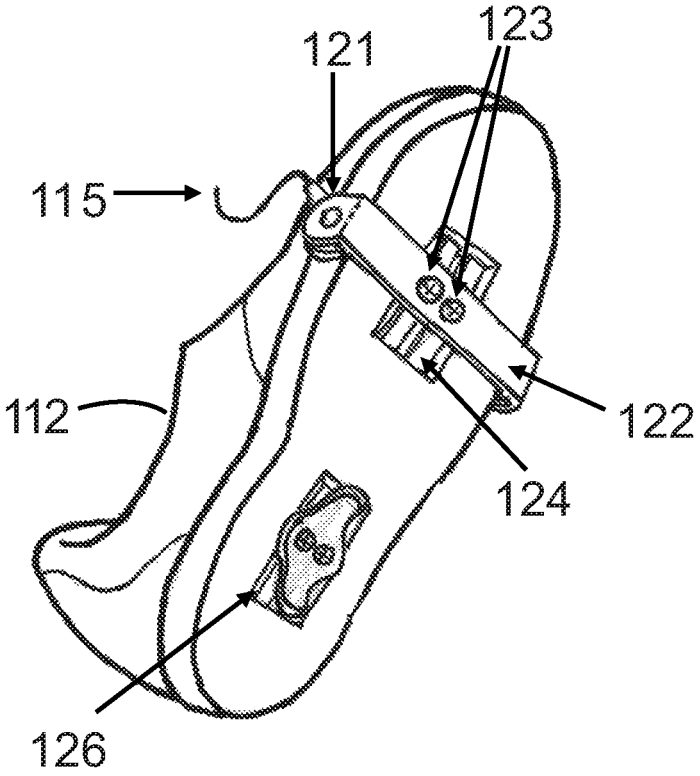
FIG. 8 is a detailed view of an optional shoe, adapted to cooperate with the system.

Looking now to FIG. 8, a novel shoe 112 is shown in greater detail. In some embodiments a rider wears regular riding shoes with the plate 122 positioned under the ball of the foot. The coupler 115, 116 may connect to the plate 122 directly or through hinges 121. In some embodiments a novel shoe is worn, wherein the sole of the novel shoe includes a clipless connector 124 approximating the position of the ball of the foot with channels running front to back, and the plate 122 has fasteners 123 connected with the clipless connector 124 to rigidly connect the plate 122 to the connector 124, and thereby to the shoe 112. The connector 124 channel may be extended in the longitudinal direction of the foot, thereby providing the wearer the ability to increase of decrease the length of the moment arm between the plate 122 and a rider's ankle. The rigid plate 122 reinforces the shoe 112 to prevent bending under load. The shoe 112 may also include a cleat 126 for rigid attachment to a pedal 123 (FIG. 7) on the bike. In some embodiments the cleat 126 is adjustable, to allow positioning to accommodate different pedaling styles and foot positions.

The connector 124 allows positioning of the plate 122 to accommodate different pedaling styles and foot positions. The connector 124 allows the plate 122 to be replaced with a standard clipless pedal cleat, giving the user the option of riding with the rigid plate 122 and the system 100, or a clipless pedal cleat without the system 100. That is, the shoe 112 is useful both with and without the other elements of system 100.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

I claim:

1. An apparatus worn by a person while riding a pedal-powered vehicle, comprising:

a body harness for fitting around a person's waist, a left and a right hinged connector, each connector comprising a fixed end and a hinged end, wherein the fixed end of each connector is affixed to the body harness such that the right hinged connector is affixed at the person's right side and the left connector is affixed at the person's left side, a left and a right outer thigh linkage, wherein each outer thigh linkage comprises a first and a second end, wherein the first end of the left outer thigh linkage is connected to the hinged end of the left hinged connector and the first end of the right outer thigh linkage is connected to the hinged end of the right hinged connector, a left and a right inner thigh linkage, wherein each inner thigh linkage is connected to a corresponding outer thigh linkage by an upper and a lower thigh brace, wherein each lower thigh brace is connected at the second end of a corresponding outer thigh linkage and further wherein each lower thigh brace is generally over a rider's knee and each outer thigh linkage and each corresponding inner thigh linkage are positioned on opposing sides of the rider's thigh, a left and a right coupler pair, each pair connected to the second end of a corresponding thigh linkage, comprising a first coupler connected to an inside edge of a rider's shoe and a second coupler connected to an outside edge of a rider's shoe, and a strap connecting each outer thigh linkage with a corresponding inner thigh linkage wherein each strap is positioned under the rider's corresponding thigh.

2. The apparatus of claim 1, further including a strap connecting the hinged connectors, wherein the strap is worn under a rider's buttocks.

3. The apparatus of claim 1, further comprising a plate connected to a second end of each coupler pair wherein the plate separates the first coupler from the second coupler and is positioned under a corresponding shoe such that a rider may power the vehicle by pushing on the plates with the rider's feet.

* * * * *